US008083023B1

(12) United States Patent
Perdue et al.

(10) Patent No.: US 8,083,023 B1
(45) Date of Patent: Dec. 27, 2011

(54) DRUM BOOTH AND KIT FOR ITS CONSTRUCTION

(76) Inventors: Joab James Perdue, Erin, TN (US); Joab Jay Perdue, Erin, TN (US)

( * ) Notice: Subject to any disclaimer, the term of this patent is extended or adjusted under 35 U.S.C. 154(b) by 0 days.

(21) Appl. No.: 12/661,985

(22) Filed: Mar. 29, 2010

(51) Int. Cl.
*E04B 1/99* (2006.01)

(52) U.S. Cl. ..... 181/198; 181/287

(58) Field of Classification Search ..... 181/30, 181/198, 287; 52/36.1, 36.2, 36.5, 63, 79.1, 52/79.4, 144, 145
See application file for complete search history.

(56) References Cited

U.S. PATENT DOCUMENTS

| | | | | |
|---|---|---|---|---|
| 3,517,468 | A * | 6/1970 | Woods | 52/79.1 |
| 3,611,907 | A * | 10/1971 | Wasserman et al. | 454/186 |
| 4,120,376 | A | 10/1978 | Palmer | |
| 4,214,411 | A * | 7/1980 | Pickett | 52/144 |
| 4,290,332 | A * | 9/1981 | Schoeffling, Jr. | 84/723 |
| 4,515,238 | A * | 5/1985 | Baker | 181/30 |
| 5,123,874 | A | 6/1992 | White | |
| 5,210,984 | A * | 5/1993 | Eckel | 52/79.5 |
| 5,525,765 | A * | 6/1996 | Freiheit | 181/30 |
| 6,305,492 | B1 * | 10/2001 | Oleiko et al. | 181/210 |
| 7,076,922 | B1 * | 7/2006 | Parres | 52/79.5 |
| 7,178,630 | B1 * | 2/2007 | Perdue | 181/290 |
| 2001/0047628 | A1 * | 12/2001 | Mouton et al. | 52/144 |
| 2006/0185268 | A1 * | 8/2006 | Wiebel et al. | 52/144 |
| 2008/0066393 | A1 * | 3/2008 | Sorensen | 52/81.1 |

OTHER PUBLICATIONS

Way Back Machine Internet Archive search of http://www.clearsonic.com, accessed original archive from May 10, 2007; p. 1 webpage from May 10, 2007, pp. 2-6 webpage from May 3, 2007, pp. 7-11 webpage from Apr. 28, 2007.*

* cited by examiner

*Primary Examiner* — Jeremy Luks
(74) *Attorney, Agent, or Firm* — Norman B. Rainer

(57) ABSTRACT

A booth for confining and acoustically isolating musical drum instruments and musicians therefor has a rear wall, front wall assembly having a number of plastic windows interconnected in a polygonal path, and a ceiling member. The windows are supported by pedestal blocks and secured in place by vertically opposed troughs in the ceiling member and pedestal blocks.

7 Claims, 4 Drawing Sheets

DRUM BOOTH AND KIT FOR ITS CONSTRUCTION

BACKGROUND OF THE INVENTION

1. Field of the Invention

The present invention relates to the production of live music, and more particularly concerns apparatus for promoting compatible interaction between loud and soft instruments of a musical band.

2. Description of the Prior Art

In the playing of live music by a band of musicians on a stage in an auditorium or concert area, the nature of the acoustic interaction of the several involved musical instruments is of critical importance. The need for proper mixing of sounds is particularly desirable where the individual instruments involve electronic amplification.

In the case of drums, their best musical characteristics are usually produced at sound intensities considerably greater than the normal sound outputs of the other instruments. For this reason, the drum players and their instruments are sometimes enclosed in an isolating booth which adjusts the emergent sound to manageable stage levels while enabling electronic coupling to a sound-mixing system that outputs sound to the audience via loudspeakers. Because music bands usually have limited performances in a specific location, the drum isolating booth must be easily erected on site, then dismantled to an easily transportable compact state.

Earlier isolation booths have been of heavy, cumbersome construction, not easily assembled on stage and/or dismantled. Also, sound-absorbing efficiencies have been low because of design configurations and materials of construction. In particular, prior isolation booths have not addressed the fact that low frequency energy, typical of drum sounds, is very difficult to absorb, and such low frequencies tend to transfer throughout a room by coupling to the floor.

It is accordingly an object of the present invention to provide an acoustically isolating booth for drums and drum players.

It is a further object of this invention to provide a drum isolating booth of the foregoing objective which can be easily constructed and dismantled.

It is another object of the present invention to provide a drum isolating booth of the aforesaid nature which efficiently absorbs low frequency sounds typically produced by drums.

It is an additional object of the present invention to provide a kit of relatively compact size containing components for the easy construction of the aforesaid isolating booth.

These objects and other objects and advantages of the invention will be apparent from the following description.

SUMMARY OF THE INVENTION

The above and other beneficial objects and advantages are accomplished in accordance with the present invention by a booth adapted to be positioned upon a substantially flat floor surface and adapted to confine and acoustically isolate musical drum instruments and musicians therefor, said booth comprising a rear wall, front wall assembly comprised of a number of plastic windows releasibly interconnected in a polygonal path, and a roof member horizontally emplaced upon said rear wall and front wall assembly, said windows being supported by pedestal blocks, said rear wall, roof member, and pedestal blocks being fabricated of rigid sound-absorbing material.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
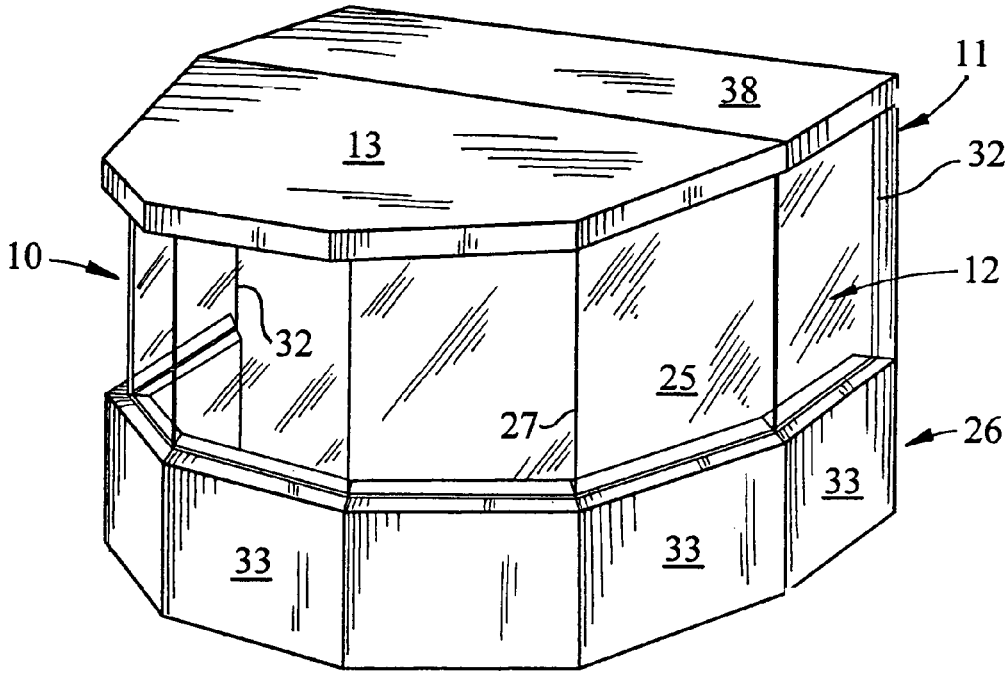
FIG. 1 is a perspective front view of a six-window embodiment of the acoustic isolating booth of the present invention.
Figure 2:
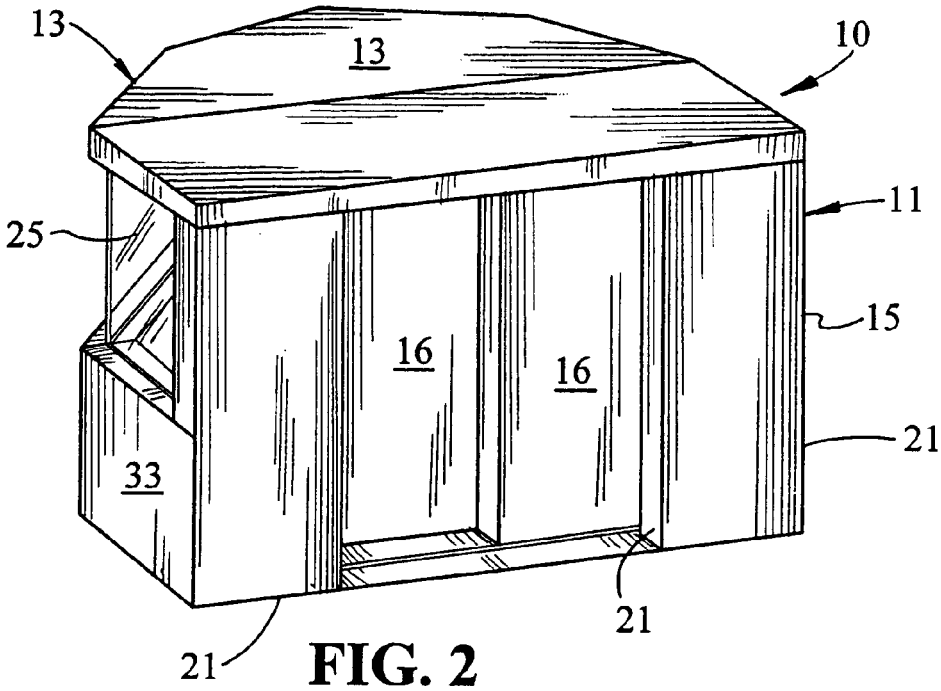
FIG. 2 is a perspective rear view thereof.
Figure 3:
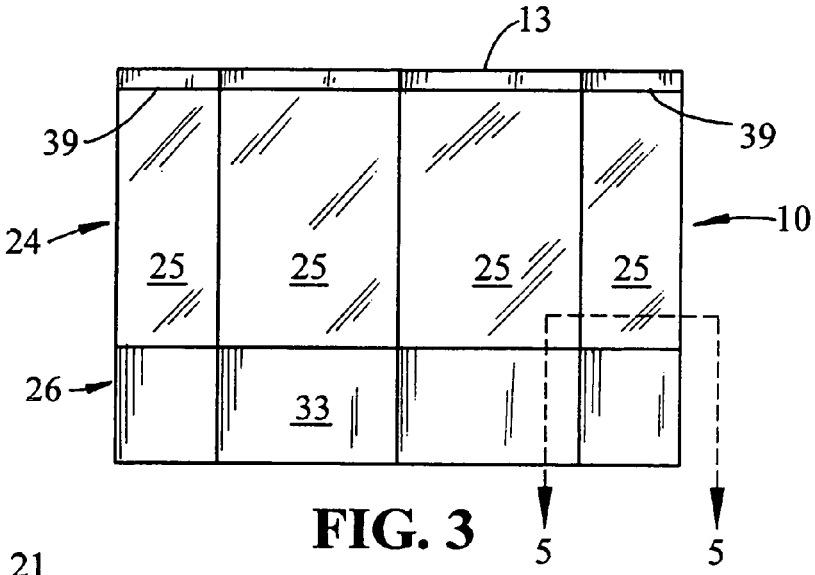
FIG. 3 is a front view thereof.
Figure 4:
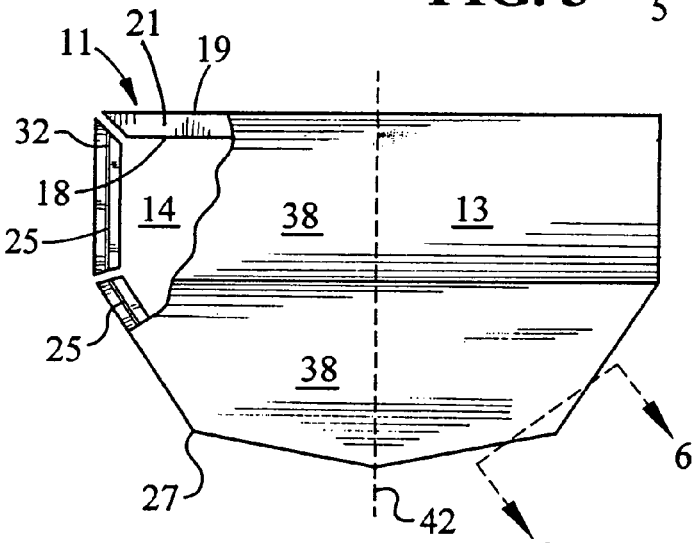
FIG. 4 is a top view thereof with portions broken away.
Figure 5:
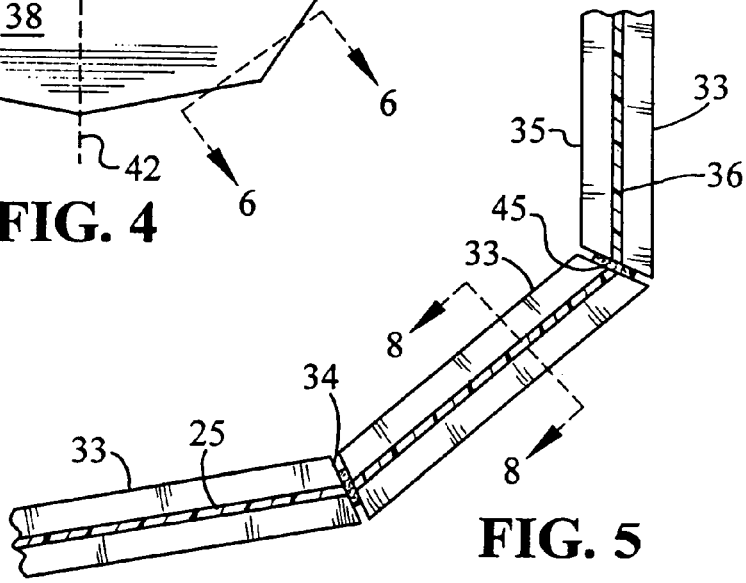
FIG. 5 is an enlarged fragmentary horizontal sectional view taken in the direction of the arrows upon line 5-5 of FIG. 3.
Figure 6:
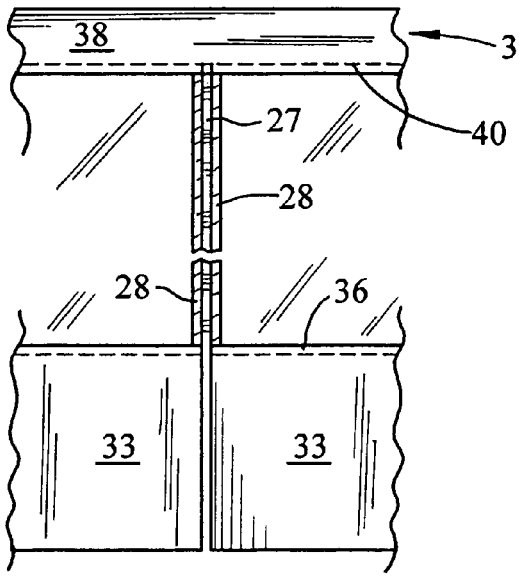
FIG. 6 is an enlarged fragmentary sectional view taken in the direction of the arrows upon line 6-6 of FIG. 4.

Referring now to FIGS. 1-4, an embodiment of the acoustic isolating booth 10 of this invention is shown comprised of vertically oriented rear wall 11 of substantially flat construction, front wall assembly 12 projecting convexly from rear wall 11, and ceiling member 13 of flat construction overlying said rear wall and front wall assembly to form therewith an enclosed booth space 14.

Rear wall 11 is comprised of opposed outer panels 15 of vertically elongated, substantially rectangular configuration, and paired center sliding door panels 16 interactive with outer panels 15. Panels 15 and 16, and other panel components subsequently described herein, are constructed of fabric-covered bonded rockwool having the characteristics defined in U.S. Pat. Nos. 5,644,872 and 7,178,630, incorporated herein by reference. In particular, said panels are produced by the spinning of molten mineral magma to form fibers of indeterminate length in layers which constitute a loose batting. Bonding agents such as phenolic resins are applied to the batting along with compactive force to produce interadherance of the fibers and a resultant self-supporting panel of controllable density. Preferred densities for the purposes of the present invention are in the range of 5 to 9 pounds/cu.ft. It has been found that, at densities below 5 lbs/cu.ft., the panels have inadequate rigidity for use in the booth structure of this invention, and at densities greater than 9 lbs/cu.ft., the panels provide inadequate absorption of sound. Within said preferred density range, said panels have a compressive modulus of 200 to 400 lbs/sq.ft. at 10% compression, and have a noise reduction coefficient (NRC) rating above, namely better than 1.20 at typical drum-produced frequencies below 125 Hz.

Figure 8:
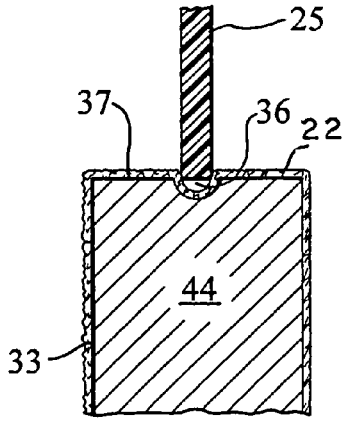
FIG. 8 is an enlarged fragmentary sectional view taken in the direction of the arrows upon line 8-8 of FIG. 5.

Panels 15 and 16 are each bounded by flat interior and exterior faces 18 and 19, respectively, and four straight flat perimeter edge surfaces 21 disposed in a rectangular configuration. Said panels are covered with a tautly drawn heavy duty fabric layer 22 similar to that shown in FIG. 8 which is bonded to the underlying rockwool 44 and folded over each edge and bonded to itself upon each edge surface. The panels have a uniform thickness in the range of 1.5 to 3.0 inches, a height of about six to seven feet, and a width, measured between vertical edge surfaces 21, of between 1.5 and 3.0 feet.

Figure 7:
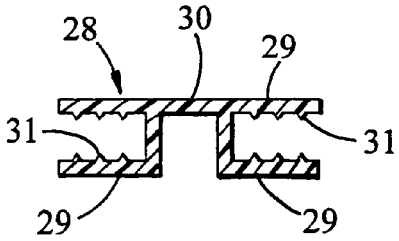
FIG. 7 is an enlarged horizontal sectional view of the hinge component employed for joining the windows of the booth of FIG. 1.

Front wall assembly 12 is comprised of upper portion 24 having a series of plastic windows 25, and a footing portion 26 which supports said windows. Said windows are preferably fabricated of polycarbonate or polyacrylic sheeting of ⅛" to ¼" thickness, and have a vertically elongated rectangular configuration with a height of 4 to 5 feet and width of about 2 feet. The vertical edges 27 of contiguous windows are interconnected by connector strips 28 which frictionally grip the windows. Preferred connector strips are fabricated of a clear resilient plastic such as plasticized polyvinyl chloride (PVC) or silicone. As best shown in FIG. 7, the connector strip is preferably an extruded shape having opposed pairs of gripping arms 29 separated by a compliant intervening strip 30 which functions as a "living" hinge. Protuberances 31 integral with the facing surfaces of arms 29 enhance the frictional holding power of said arms. The embodiment exemplified in FIGS. 1-4 has six windows interconnected upon a semi-circular path to form upper portion 24 having opposed terminal edges 32 that interact with rear wall 11.

Footing portion 26 is comprised of a series of pedestal blocks 33, the number of which corresponds to the number of windows. The blocks are of substantially the same construction as the aforementioned rear wall panels 15 and 16, but have a somewhat greater thickness of about 4½". Also, the opposed vertical edge surfaces 34 of the blocks are convergently angled toward the interior face 35 of the block, producing a trapezoidal top profile. Hook and loop fiber fastening strips such as VELCRO 45 are attached to edge surfaces 34, thereby permitting sequential interengagement of the blocks upon a flat floor surface. A centered trough 36 of about ¼" depth is centered in the upper edge surface 37 of each block for the purpose of seating the lowermost edge of an associated window. The blocks 33 further serve to absorb reverberation sound within the booth, and minimize sound transmission through the floor, which is an otherwise significant problem with the low frequency sounds produced by drums. Another advantage of the specialized characteristics and placement of the blocks is that they permit passage of speaker cables on the floor beneath the blocks without impairing the sound-absorbing efficiency of the booth.

Ceiling member 13 is comprised of two or more large panels 38 horizontally placed to seat upon the upper edges of the windows and rear wall 11. VELCRO material may be used to secure rear panel 38 to the upper edges of panels 15. Panels 38 are otherwise of essentially the same construction as panels 15 and 16. Troughs 40 of about ¼" depth are recessed into the lower surfaces of panels 38 at peripheral locations to receive and secure the upper edges of the windows. Except for the staggered positioning of door panels 16, the assembled booth has a plane of symmetry 42 vertically centered between terminal edges 32 of said window assembly.

Figure 9:
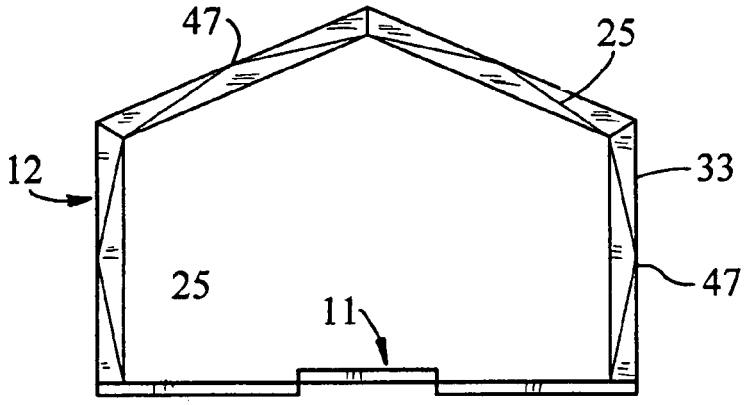
FIG. 9 is a schematic top view of a first alternative embodiment having eight windows.
Figure 10:
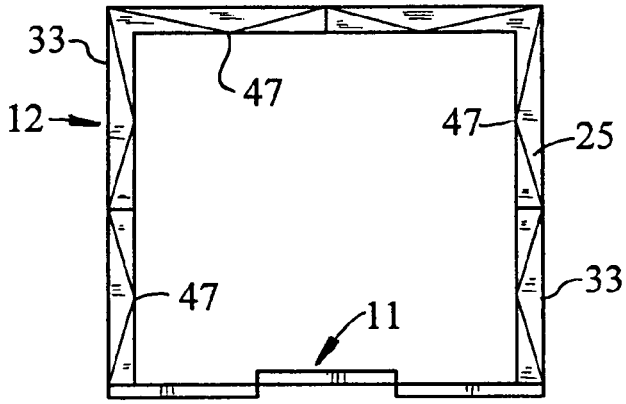
FIG. 10 is a schematic top view of a second alternative embodiment having twelve windows in a square array.
Figure 11:
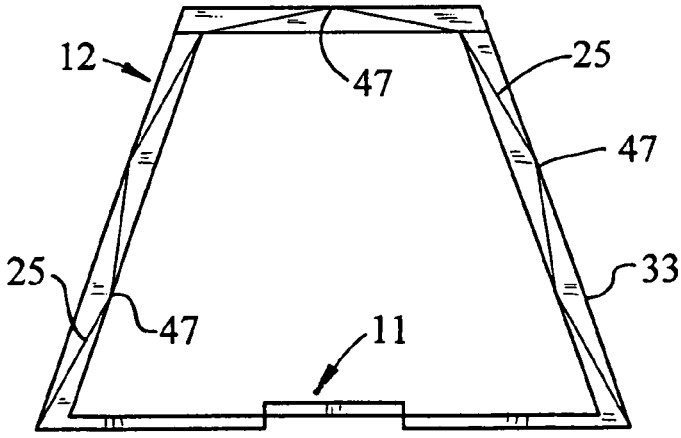
FIG. 11 is a schematic top view of a third alternative embodiment having eight windows in a trapezoidal array.

The first, second and third alternative embodiments of the acoustic isolation booth of the present invention, shown in FIGS. 9, 10 and 11, respectively, differ from the primary embodiment of FIGS. 1-4 substantially only in the manner of securement of the lower extremities of the windows by the pedestal blocks, and the geometrical floor plan of the wall assembly. In particular, the securing troughs 36, instead of being centered within upper edge surface 37 of each pedestal block, is angularly positioned, and at least two separate troughs meet at an apex 47 within edge surface 37. Such modifications have been found to impart increased structural integrity to the wall assembly, and increased attenuation of sound within the booth.

The aforesaid components of the booth are employed as a kit of relatively compact size which facilitates transportation and storage, and enables the booth to be easily installed upon a flat surface, and easily dismantled. For compactness, the windows, preferably of identical size for a particular booth, may be stacked, then interconnected at the site of construction. The fact that the kit includes multiple identical components such as the windows and footing panels, facilitates rapid assembly. No tools are necessary because of the self-integrating features of the several components.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described our invention, what is claimed is:

1. A booth adapted to be positioned upon a substantially flat floor surface and adapted to confine and acoustically isolate musical drum instruments and musicians therefor, said booth comprising a rear wall, front wall assembly comprised of a number of vertically oriented plastic windows releasably interconnected in a polygonal path, and a ceiling member horizontally emplaced upon said rear wall and front wall assembly to define therewith an enclosed space, said windows being supported by pedestal blocks, said rear wall, ceiling member, and pedestal blocks being fabricated of substantially rigid fabric-covered sound-absorbing bonded rockwool structure having a density in the range of 5 to 9 pounds per cubic foot and a compressive modulus of 200 to 400 pounds per square foot at 10% compression, said pedestal blocks having a thickness of 4-5 inches, a flat upper surface having a trough which seats the lower edge of an associated window, and opposed vertical edge surfaces convergently angled toward the interior of said booth, thereby producing a trapezoidal configuration which permits sequential tight-fitting abutment of a number of said blocks upon a flat floor in a polygonal path, said blocks permitting passage thereunder of electric cables without impairing the acoustic isolation efficiency of the booth.

2. The booth of claim 1 wherein said rear wall contains a door.

3. The booth of claim 2 wherein said door is a sliding panel.

4. The booth of claim 1 wherein said windows are of rectangular configuration bounded by paired vertical edges and upper and lowermost edges, and are joined by connector strips which frictionally grip the vertical edges of contiguous windows and function as resilient hinges.

5. The booth of claim 1 wherein said ceiling member contains troughs which accommodate the upper edges of said windows.

6. The booth of claim 1 in the form of a kit of relatively compact size which facilitates transportation and storage, and enables the booth to be easily installed upon a flat floor surface.

7. The booth of claim 1 wherein the opposed vertical edge surfaces of said pedestal blocks contain hook and loop fiber fastening strips.

* * * * *